US011284200B2

(12) United States Patent
Tsuchihashi et al.

(10) Patent No.: US 11,284,200 B2
(45) Date of Patent: Mar. 22, 2022

(54) TRANSDUCER

(71) Applicant: Yamaha Corporation, Shizuoka (JP)

(72) Inventors: Yu Tsuchihashi, Shizuoka (JP); Tomoya Miyata, Shizuoka (JP)

(73) Assignee: YAMAHA CORPORATION, Shizuoka (JP)

( * ) Notice: Subject to any disclaimer, the term of this patent is extended or adjusted under 35 U.S.C. 154(b) by 0 days.

(21) Appl. No.: 16/851,967

(22) Filed: Apr. 17, 2020

(65) Prior Publication Data

US 2020/0245074 A1 Jul. 30, 2020

Related U.S. Application Data

(63) Continuation of application No. PCT/JP2018/040302, filed on Oct. 30, 2018.

(30) Foreign Application Priority Data

Nov. 1, 2017 (JP) ..... JP2017-212229

(51) Int. Cl.
*H04R 17/00* (2006.01)
*H04R 1/10* (2006.01)

(52) U.S. Cl.
CPC ..... *H04R 17/00* (2013.01); *H04R 1/1075* (2013.01)

(58) Field of Classification Search
CPC ..... H04R 1/10; H04R 1/1075; H04R 17/00; H04R 17/005
See application file for complete search history.

(56) References Cited

U.S. PATENT DOCUMENTS 4,654,554 A * 3/1987 Kishi ..... H04R 1/22 310/322
5,022,486 A * 6/1991 Miura ..... G10K 11/22 181/132
6,995,659 B2 * 2/2006 Soto-Nicolas ..... H04R 1/225 340/384.1
8,942,406 B2 * 1/2015 Koizumi ..... H04R 1/1091 381/380
9,025,795 B2 * 5/2015 Adachi ..... H04R 11/02 381/151
9,967,643 B2 * 5/2018 Hirano ..... H04R 1/105
10,511,902 B2 * 12/2019 Yamada ..... H04R 1/1016
2011/0274301 A1 * 11/2011 Peck ..... H04R 17/00 381/190

(Continued)

FOREIGN PATENT DOCUMENTS

CN 107155406 A 9/2017
GB 1500764 A * 2/1978 ..... H04M 1/05

(Continued)

OTHER PUBLICATIONS

Translation of Office Action in the corresponding Chinese Patent Application No. 2018800642921, dated Sep. 22, 2020.

(Continued)

*Primary Examiner* — Ryan Robinson
(74) *Attorney, Agent, or Firm* — Global IP Counselors, LLP

(57) ABSTRACT

A transducer includes a hollow housing, and a piezoelectric sheet which is disposed on a first portion of an inner wall of the housing, and a block which is disposed on a second portion of the inner wall of the housing.

9 Claims, 5 Drawing Sheets

(56) References Cited

U.S. PATENT DOCUMENTS

| | | | | |
|---|---|---|---|---|
| 2014/0193022 | A1 | 7/2014 | Koizumi | |
| 2016/0119719 | A1 | 4/2016 | Doshida et al. | |
| 2016/0183006 | A1* | 6/2016 | Tokuhisa | H04R 1/06 381/190 |
| 2017/0150247 | A1* | 5/2017 | Smith | H04R 1/02 |
| 2018/0160209 | A1* | 6/2018 | Ogata | H04R 1/1016 |
| 2018/0176692 | A1* | 6/2018 | Dos | H04R 17/10 |
| 2020/0021929 | A1* | 1/2020 | Farrar-Gaines | H04R 17/005 |
| 2020/0154213 | A1* | 5/2020 | Miyata | H01L 41/053 |

FOREIGN PATENT DOCUMENTS

| | | | | |
|---|---|---|---|---|
| JP | S57131081 | U | 8/1982 | |
| JP | S63312799 | A | 12/1988 | |
| JP | H09252496 | A | 9/1997 | |
| JP | 2013017150 | A | 1/2013 | |
| JP | 2016086398 | A | 5/2016 | |
| WO | WO-2014162409 | A1 * | 10/2014 | H04R 1/1016 |
| WO | 2016067681 | A1 | 5/2016 | |

OTHER PUBLICATIONS

International Search Report in PCT/JP2018/040302, dated Jan. 15, 2019.

An Office Action in the corresponding Chinese Patent Application No. 201880064292.1, dated Apr. 16, 2021.

An Office Action in the corresponding Japanese Patent Application No. 2017-212229, dated Aug. 3, 2021.

A Notice of Third Review Opinon in the corresponding Chinese Patent Application No. 201880064292.1, dated Sep. 27, 2021.

* cited by examiner

TRANSDUCER

CROSS-REFERENCE TO RELATED APPLICATIONS

This application is a continuation application of International Application No. PCT/JP2018/040302, filed on Oct. 30, 2018, which claims priority to Japanese Patent Application No. 2017-212229 filed in Japan on Nov. 1, 2017. The entire disclosures of International Application No. PCT/JP2018/040302 and Japanese Patent Application No. 2017-212229 are hereby incorporated herein by reference.

BACKGROUND

Technological Field

The present disclosure relates to a transducer that transduces an electronic signal into sound or sound into an electronic signal.

Background Information

As an example of this type of transducer, there is a transducer that utilizes a piezoelectric element. For example, the earphone disclosed in Japanese Laid-Open Patent Application No. 2016-86398 is provided with a diaphragm the housing of the earphone and a piezoelectric element is fixed to the diaphragm. Then, when an electronic signal is applied to the piezoelectric element, the piezoelectric element and the diaphragm vibrate, and air pressure waves that are thereby generated reach the external auditory canal of the user via the sound path of the earphone.

SUMMARY

In the conventional transducer described above, it is difficult to increase the area of the piezoelectric element, which is a sound generating body, so that there is the problem that it is difficult to obtain a large sound pressure. In addition, the example described above relates to a transducer that carries out conversion of an electronic signal into sound, but there is a similar problem with the transducer of a microphone, etc., which carries out conversion of sound into an electronic signal using a piezoelectric element. That is, since it is difficult to increase the area of the piezoelectric element, it is difficult to obtain an electronic signal of large amplitude.

In consideration of the circumstances described above, an object of the present disclosure is to provide a technical means with which it possible to increase the sound pressure of the sound obtained from a transducer or the amplitude of the electronic signal obtained from a transducer.

This disclosure provides a transducer comprising a hollow housing, a piezoelectric sheet which is disposed on a first portion of an inner wall of the housing, and a block which is disposed on a second portion of the inner wall of the housing.

According to this disclosure, the piezoelectric sheet is provided covering at least a portion of the housing, so that it is possible to increase the area thereof. Accordingly, in a transducer that carries out conversion from an electronic signal into sound, it becomes possible to increase the sound pressure that is applied to the acoustic space due to the vibrations of the piezoelectric sheet. In addition, in a transducer that transduces sound into an audio signal, it becomes possible to increase the amplitude of the electronic signal obtained from the piezoelectric sheet due to the acoustic vibrations that are produced in the acoustic space.

DETAILED DESCRIPTION OF THE EMBODIMENTS

Selected embodiments of the present disclosure will now be explained below with reference to the drawings. It will be apparent to those skilled in the field from this disclosure that the following descriptions of the embodiments are provided for illustration only and not for the purpose of limiting the invention as defined by the appended claims and their equivalents.

First Embodiment

Figure 1A:
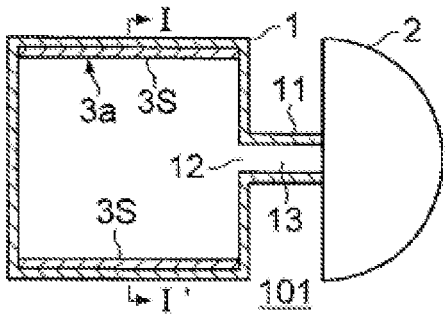
FIGS. 1A and B are views illustrating a configuration of an earphone, which is a first embodiment of a transducer according to the present disclosure.
Figure 1B:
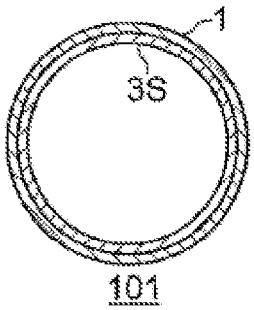

FIGS. 1A and B are views illustrating a configuration of an earphone 101, which is the first embodiment of the transducer according to the present disclosure. More specifically, FIG. 1A illustrates a vertical cross-sectional structure of a housing (hollow housing) 1 of the earphone 101 and the interior thereof, and FIG. 1B illustrates the cross-sectional structure taken along line I-I' of FIG. 1A.

In the earphone 101, the housing 1 is a hollow cylindrical member. The housing 1 is connected to an earpiece 2 by a connection tube 11. The connection tube 11 is a hollow tube, and one end thereof is connected to a sound emission hole 12 provided essentially at the center of a first bottom surface of the housing 1 shown on the right side in FIG. 1A. The sound emission hole 12 is configured to emit a sound (sound waves) from an internal space of the housing 1 to an external space of the housing 1. A sound path 13, which is a hollow area inside the connection tube 11, is connected to a hollow area inside the housing 1 via the sound emission hole 12. The materials of the housing 1 and the connection tube 11 are arbitrary, and can be, for example, resin. The earpiece 2, is an essentially hemispherical member that is inserted inside the user's ear canal, and is composed of a flexible material. A sound path (not shown) connected to the sound path 13 of the connection tube 11 passes through the earpiece 2.

The piezoelectric sheet 3*a* is disposed on a portion of an inner wall of the housing 1. For example, the piezoelectric sheet 3*a* is fixed to at least the portion of the inner wall of the housing 1. In the first embodiment, as shown in FIGS. 1A and B, the housing 1 has a cylindrical shape, and the hollow housing includes a tubular inner wall. A side surface portion (the tubular inner wall) of the inner wall surface of the cylindrical housing 1 constituting a side surface of the cylinder is covered by a hollow cylindrical piezoelectric sheet 3*a* composed of only the side surface portion 3S. Specifically, the piezoelectric sheet 3*a* is bonded to the tubular inner wall of the housing 1. In other words, the entire inner surface of the tubular portion of the inner wall of the cylindrical housing 1 is covered by the piezoelectric sheet 3*a*. In addition, with regard to the inner wall of the housing 1, the inner surfaces other than that of the inner surface of the tubular portion, that is, a circular bottom surface (one example of a first surface) and a circular surface facing the bottom surface (one example of a second surface) and on which the sound emission hole 12 is formed, are not covered by the piezoelectric sheet 3*a*. The piezoelectric sheet 3*a* can be configured to cover a portion of the inner surface of the tubular portion instead of the entire inner surface of the tubular portion.

Figure 2:
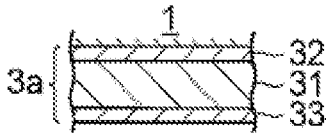
FIG. 2 is a cross-sectional view illustrating a configuration example of a piezoelectric sheet in the same embodiment.

FIG. 2 is a cross-sectional view illustrating a configuration example of the piezoelectric sheet 3*a*. In FIG. 2, the housing 1 is shown together with the piezoelectric sheet 3*a* in order to facilitate understanding of the relationship between the piezoelectric sheet 3*a* and the housing 1.

The piezoelectric element 3*a* is flexible. As shown in FIG. 2, the piezoelectric sheet 3*a* has a porous film 31 and a pair of film-like electrodes 32, 33 that are laminated on both sides of the porous film 31. The piezoelectric sheet 3*a* is a three-layer body in which the pair of electrodes 32, 33 constitute the outermost layers. Then, one of the pair of electrodes 32, 33 (electrode 32 in the example shown) is bonded to the inner wall of the housing 1. In addition, the piezoelectric sheet 3*a* has a terminal (not shown) to which a lead wire is connected that outputs an electric signal to the outside. In the piezoelectric sheet 3*a*, when an AC voltage is applied between the pair of electrodes 32, 33 via the lead wire, the porous film 31 vibrates in the thickness direction, thereby emitting sound.

The porous film 31 is flexible. The main component of the porous film 31 is a synthetic resin such as polyethylene terephthalate, tetrafluoroethylene/hexafluoropropylene copolymer, and polypropylene. In addition, the porous film 31 is electretized by a polarization process. The method for the polarization process is not particularly limited; examples include a method in which a DC or a pulsed high voltage is applied to inject charge; a method in which ionizing radiation, such as y rays or electron beams, are irradiated to inject charge; and a method in which a corona discharge treatment is used to inject charge. The "main component" refers to the component of greatest content, for example, the component with a content of 50 mass % or more.

The details of the earphone 101 according to the present embodiment were described above.

In the present embodiment, when an AC signal is applied to the piezoelectric sheet 3*a*, the piezoelectric sheet 3*a* vibrates in the thickness direction. Here, the housing 1 to which the piezoelectric sheet 3*a* is fixed can be considered a rigid body, so that the internal volume does not change. Accordingly, when the piezoelectric sheet 3*a* vibrates in the thickness direction, the volume of air inside the housing 1 facing the piezoelectric sheet 3*a* changes, and the changes in air pressure produce waves in the acoustic space inside the housing 1. The air pressure waves, that is, the sound waves, are transmitted to the user's ear canal via the sound emission hole 12, the sound path 13 and the sound path in the earpiece 2, and are heard as sound by the user.

According to the present embodiment, the piezoelectric sheet 3*a* is provided covering the side surface of the inner wall (inside wall) of the housing 1. Accordingly, it is possible to increase the area of the piezoelectric sheet 3*a* and to increase the sound pressure supplied into the acoustic space. In addition, according to the present embodiment, since the piezoelectric sheet 3*a* is bonded to the inner wall (inside wall) of the housing 1, which is a rigid body, stable emission of sound is possible. Additionally, when the area of the piezoelectric sheet 3*a* is sufficiently ensured, the piezoelectric sheet 3*a* can be disposed so as to cover at least a portion of the side surface of the inner wall of the housing 1.

Second Embodiment

Figure 3:
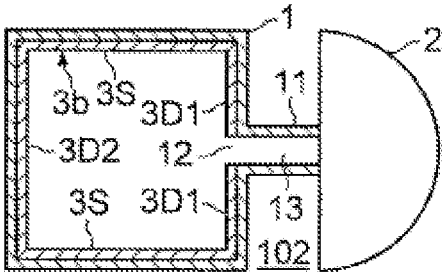
FIG. 3 is a view illustrating a configuration of an earphone, which is a second embodiment of the transducer according to the present disclosure.

FIG. 3 is a view illustrating a configuration of an earphone 102, which is the second embodiment of the transducer according to the present disclosure. As in FIG. 1A above, FIG. 3 specifically illustrates a vertical cross-sectional structure of the housing 1 of the earphone 102 and the interior thereof. In FIG. 3, parts corresponding to the respective parts shown in FIGS. 1A and B are assigned the same reference numerals, and the descriptions thereof have been omitted.

The earphone 102 according to the present embodiment is provided with a piezoelectric sheet 3*b* composed of the side surface portion 3S that covers the inside surface of the inner wall of the cylindrical housing 1, a first bottom surface portion 3D1 that covers a first bottom surface (bottom surface portion on the right side in FIG. 3, and, of the two bottom surface portions, the bottom surface portion in which the sound emission hole 12 is formed; one example of a first surface), and a second bottom surface portion 3D2 that covers a second bottom surface (bottom surface portion on the left side in FIG. 3, and, of the two bottom surface portions, the bottom surface portion in which the sound emission hole 12 is not formed; one example of a second surface). The piezoelectric sheet 3*b* is bonded to the inner wall of the housing 1. The configuration of the piezoelectric sheet 3*b* is the same as the configuration of the piezoelectric sheet 3*a* according to the first embodiment (refer to FIG. 2). The side surface portion 3S of the piezoelectric sheet 3*b* can be configured to cover a portion instead of the entire inside surface of the housing 1, and the first bottom surface portion 3D1 and the second bottom surface portion 3D2 of the piezoelectric sheet 3*b* can be configured to cover a portion of the first and second bottom surfaces instead of the entire first and second bottom surfaces.

The same effects as those in the first embodiment can be obtained in the present embodiment. In addition, according to the present embodiment, the area of the piezoelectric sheet 3*b* facing the acoustic space inside the housing 1 can be made larger than the area of the piezoelectric sheet 3*a* of the first embodiment. Accordingly, it is possible to make the sound pressure obtained in the earphone 102 greater than in the first embodiment. In addition, in FIG. 3, the piezoelectric sheet 3*b* can include only the side surface portion 3S and the second bottom surface portion 3D2 while omitting the first bottom surface portion 3D1 that covers the first bottom surface; include only the side surface portion 3S and the first bottom surface portion 3D1 while omitting the second bottom surface portion 3D2 that covers the second bottom surface; or include only the first bottom surface portion 3D1 and the second bottom surface portion 3D2 while omitting the side surface portion 3S that covers the inside surface. Additionally, when the area of the piezoelectric sheet 3*b* is sufficiently ensured, it can be partially disposed on each surface. That is, the piezoelectric sheet 3*b* can be disposed so as to cover at least a portion of the inner wall of the housing 1.

Third Embodiment

Figure 4A:
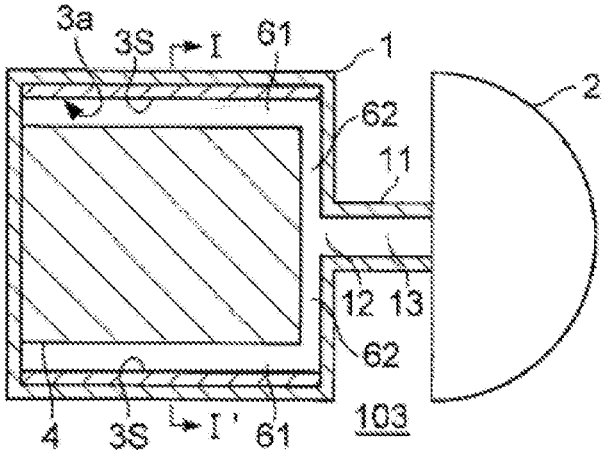
FIGS. 4A-4D are views illustrating a configuration of an earphone, which is a third embodiment of the transducer according to the present disclosure.
Figure 4B:
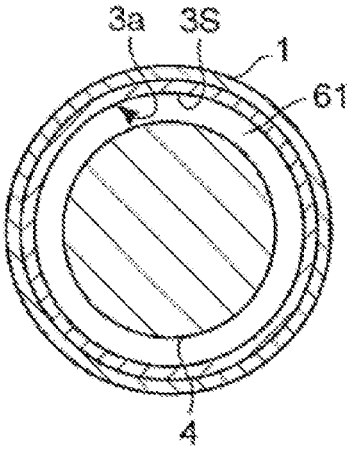
Figure 4C:
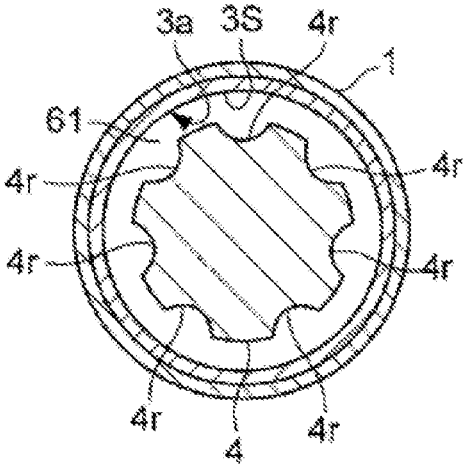
Figure 4D:
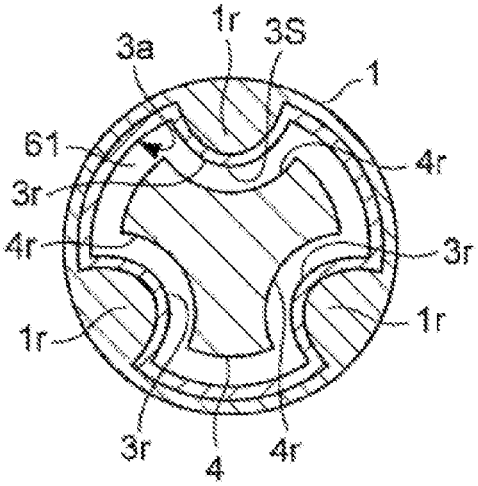

FIGS. 4A to 4D are views illustrating a configuration of an earphone 103 which is the third embodiment of the transducer according to the present disclosure. More specifically, FIG. 4A illustrates a vertical cross-sectional structure of the housing 1 of the earphone 103 and the interior thereof, and FIGS. 4B to 4D illustrate the cross-sectional structure taken along line I-I' of FIG. 4A. In the present embodiment, various aspects of the housing 1 and the cross-sectional structure taken along line I-I' therein can be considered. FIGS. 4B to 4D respectively illustrate first to third aspects of said aspects. In FIGS. 4A to 4D, parts corresponding to the respective parts shown in FIGS. 1A and B have been assigned the same reference numerals, and the descriptions thereof have been omitted.

As in the first embodiment, in the earphone 103 according to the present embodiment, the piezoelectric sheet 3*a*, which is composed of only the side surface portion 3S covering the inside surface of the inner wall of the cylindrical housing 1, is bonded to the inner wall (in this case, the inside wall) of the housing 1. The configuration of the piezoelectric sheet 3*a* is the same as that of the first embodiment.

A block 4 is disposed inside the housing 1. More specifically, the block 4 is disposed on a portion of the inner wall of the housing 1. In the second embodiment, an axially symmetrical tubular block 4 is fixed in the acoustic space inside the housing 1 facing the piezoelectric sheet 3*a*. More specifically, in the block 4, the side surface is separated from the piezoelectric sheet 3*a*, and a second bottom surface (bottom surface on the left side of the block 4 in FIG. 4A) is adhered to a second bottom surface (one example of a second surface) of the housing 1, in a state in which a first bottom surface (bottom surface on the right side of the block 4 in FIG. 4A and the bottom surface that is mutually opposed to the second bottom surface, which is one example of a surface of the housing 1 in which the sound emission hole 12 is formed) is separated from a first bottom surface (one example of a first surface) of the housing 1. A space 61 between the side surface of this block 4 and the side surface portion 3S of the piezoelectric sheet 3*a* and a space 62 between the first bottom surface of the block 4 have the function of guiding air pressure waves (sound waves) that are generated due to the vibration of the piezoelectric sheet 3*a* to the sound emission hole 12. The material of the block 4 is arbitrary and can be, for example, resin. The shape of the block 4 can be a hollow cylindrical shape or a solid columnar shape. In addition, the block 4 is fixed to a portion (one example of a second portion) of the inner wall of the housing 1 that is not covered by the piezoelectric sheet 3*a*, which is different from the portion (one example of a first portion) that is covered by the piezoelectric sheet 3*a*.

In the first aspect shown in FIG. 4B, the housing 1, the piezoelectric sheet 3*a*, and the block 4 form a concentric cylindrical shape. The space 61 between the piezoelectric sheet 3*a* and the block 4 has an annular cross-sectional shape in which the thickness thereof in the radial direction of the block 4 is uniform along the circumferential direction of the block 4. The space 61 also has a cross-sectional shape in which the thickness (dimension) thereof in the radial direction of the block 4 is uniform along a direction from the first bottom surface to the second bottom surface of the block 4. The thickness (dimension) of the space 61 in the radial direction of the block 4 can be configured to be non-uniform along the circumferential direction of the block 4 and can be configured to be non-uniform along the direction from the first bottom surface to the second bottom surface of the block 4. The same applies to the following aspects and embodiments.

In the second aspect shown in FIG. 4C, the block 4 does not have the shape of a perfect cylinder, and a plurality (seven in the shown example) of arcuate grooves 4*r* are provided along the circumferential direction thereof.

In the third aspect shown in FIG. 4D, a plurality (three in the shown example) of arcuate grooves 4*r* are provided along the circumferential direction of the block 4, and a plurality of convex portions 1*r*, which project toward these grooves 4*r* in an arcuate shape, are provided on the inside surface (inner surface of the tubular portion) of the housing 1. Convex portions 3*r* of the piezoelectric sheet 3*a*, which project toward the grooves 4*r* in an arcuate shape, are provided on the surfaces of these convex portions 1*r*. In this aspect, in the radial direction of the block 4, the thickness of the space 61 between the piezoelectric sheet 3*a* and the block 4 is uniform along the circumferential direction of the block 4.

The same effects as those in the first embodiment can be obtained in the present embodiment. In addition, in the present embodiment, the block 4 is disposed in the housing 1 to thereby form a sound propagation path from the space 61→the space 62→the sound path 13. As a result, by adjusting the shape of the space 61, for example, as shown in FIGS. 4B to 4D, or the thickness of the space 62, abrupt changes in the cross-sectional area of the sound propagation path (or abrupt changes in acoustic impedance) can be diminished, and the effect of being able to suppress the occurrence of Helmholtz resonance and reflection in the propagation path can be obtained.

Fourth Embodiment

Figure 5:
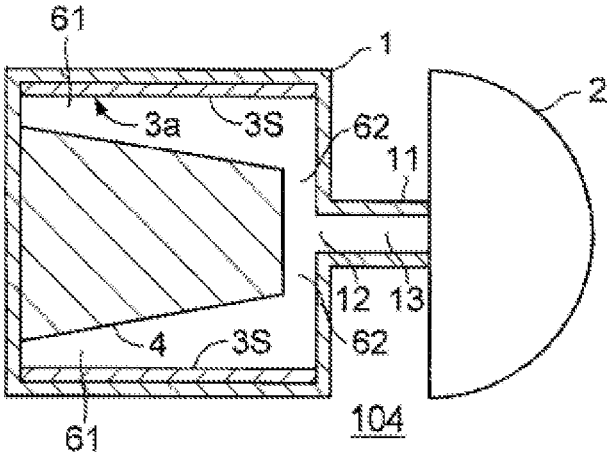
FIG. 5 is a view illustrating a configuration of an earphone, which is a fourth embodiment of the transducer according to the present disclosure.

FIG. 5 is a view illustrating a configuration of an earphone 104, which is the fourth embodiment of the transducer according to the present disclosure. In FIG. 5, parts corresponding to the respective parts shown in FIG. 1 or 4 have been assigned the same reference numerals, and the descriptions thereof have been omitted.

In the present embodiment, as shown in FIG. 5, block 4 of the third embodiment is replaced with block 4, which has a truncated conical shape in which the diameter decreases from the second bottom surface (bottom surface on the left side in FIG. 5) side of the housing 1 to the first bottom surface (bottom surface on the right side in FIG. 5).

The same effects as those in the third embodiment can be obtained in the present embodiment.

Fifth Embodiment

Figure 6:
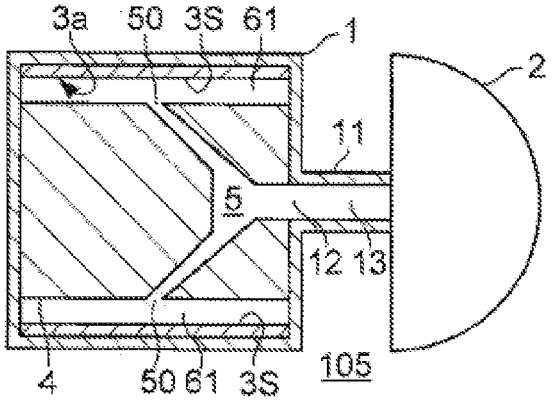
FIG. 6 is a view illustrating a configuration of an earphone, which is a fifth embodiment of the transducer according to the present disclosure.

FIG. 6 is a view illustrating a configuration of an earphone 105, which is the fifth embodiment of the transducer according to the present disclosure. In FIG. 6, parts corresponding to the respective parts shown in FIG. 1 or 4 have been assigned the same reference numerals, and the descriptions thereof have been omitted.

As in the first embodiment, in the earphone 105 according to the present embodiment, the piezoelectric sheet 3*a*, composed of only the side surface portion 3S covering the inside surface of the inner wall of the cylindrical housing 1, is bonded to the inner wall (in this case, the inside wall) of the housing 1. The configuration of the piezoelectric sheet 3*a* is the same as that of the first embodiment.

A cylindrical block 4 is fixed in the acoustic space inside the housing 1 facing the piezoelectric sheet 3*a*. More specifically, in the block 4, the side surface is separated from the piezoelectric sheet 3*a*, a first bottom surface thereof (bottom surface on the right side in FIG. 6) is adhered to a first bottom surface of the housing 1, and a second bottom surface thereof (bottom surface on the left side in FIG. 6) is adhered to a second bottom surface of the housing 1. As in the aspect shown in FIG. 4B, the space 61 between the piezoelectric sheet 3*a* and the block 4 has an annular cross-sectional shape in which the thickness in the radial direction of the block 4 is uniform along the circumferential direction of the block 4. The block 4 can be adhered to either the first bottom surface or the second bottom surface of the housing 1.

In the present embodiment, the space 61 between the piezoelectric sheet 3*a* and the block 4 functions as a compression layer that contains air that is compressed due to the vibrations of the piezoelectric sheet 3*a*. In the present embodiment, a through-hole 5, which guides the air inside the space 61 facing the piezoelectric sheet 3*a* to the sound emission hole 12 provided in the housing 1, is formed on the block 4.

In the example shown in FIG. 6, the through-hole 5 is composed of a cylindrical hollow area having essentially the same diameter as the sound path 13, and a hollow area that branches from this hollow area and that extends radially toward the side surface of the cylindrical block 4. Then, an opening 50 of the through-hole 5 is provided on the side surface of the block 4. The opening 50 is a circular opening that runs once around the side surface of the cylindrical block 4. In the shown example, the opening 50 is located at the axial center of the side surface of the cylindrical block 4.

Since the through-hole 5 has the function of guiding sound from the space 61 to the sound path 13, it is necessary to set its shape so that there is no sound reflected at the boundary between the space 61 and the through-hole 5, nor at the boundary between the through-hole 5 and the sound path 13. Therefore, the cross-sectional area of the through-hole 5 changes smoothly from the boundary with the space 61 to the sound emission hole 12, such that abrupt changes in the cross-sectional area of the sound propagation path (that is, abrupt changes in the acoustic impedance) do not occur.

In the present embodiment, when the piezoelectric sheet 3*a* vibrates in the thickness direction, the air volume inside the space 61, which is the compression layer, changes, to thereby generate air pressure waves inside the space 61. The air pressure waves propagate to the through-hole 5 in the block 4 via the opening 50 to the user's ear canal via the through-hole 5, the sound emission hole 12, and the sound path 13, and are heard as sound by the user.

The same effects as those in the first embodiment can be obtained in the present embodiment. In addition, in the present embodiment, since the block 4 is disposed in the housing 1 and the through-hole 5 that guides the air inside the space 61 to the sound emission hole 12 is provided in the block 4, abrupt changes in the cross-sectional area of the sound propagation path from the space 61 to the sound path 13 can be reduced. Accordingly, it is possible to suppress reflection of sound in the sound propagation path from the space 61 to the sound path 13 and to improve the acoustic characteristics.

There is the possibility of generating a standing wave in the space 61 inside the housing 1, the wavelength of which is determined by the size and shape thereof, due to the vibration of the piezoelectric sheet 3*a*. The standing wave causes the occurrence of peaks and dips in the acoustic characteristics of the earphone 105. It is preferable that such peaks and dips do not occur in the frequency range used by the earphone 105 (frequency range of the sound to be reproduced by the earphone 105). Therefore, in order to reduce the influence of such an undesirable standing wave, the location of the opening 50 of the through-hole 5 can be matched to the positions at which the nodes of the standing wave occur in the space 61. In this way, the influence of the standing wave of the space 61 with respect to the acoustic characteristics of the earphone 105 can be reduced.

Sixth Embodiment

Figure 7:
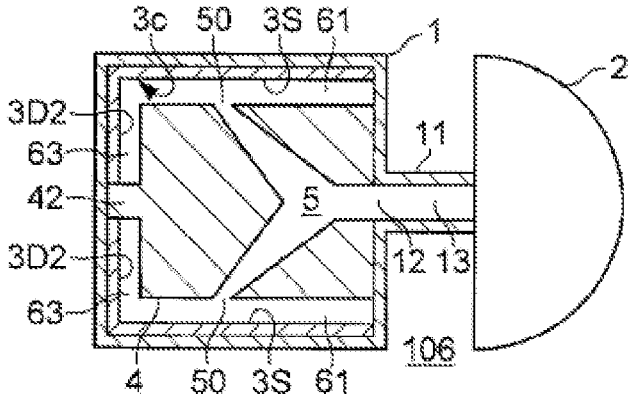
FIG. 7 is a view illustrating a configuration of an earphone, which is a sixth embodiment of the transducer according to the present disclosure.

FIG. 7 is a view illustrating a configuration of an earphone 106, which is the sixth embodiment of the transducer according to the present disclosure. In FIG. 7, parts corresponding to the respective parts shown in FIG. 6 have been assigned the same reference numerals, and the descriptions thereof have been omitted.

The earphone 106 according to the present embodiment is provided with a piezoelectric sheet 3*c* composed of the side surface portion 3S that covers the inside surface of the inner wall of the cylindrical housing 1, and the second bottom surface portion 3D2 that covers the second bottom surface (bottom surface portion on the left side in FIG. 7). The piezoelectric sheet 3*c* is bonded to the inner wall of the housing 1.

The block 4 is disposed in the acoustic space inside the housing 1 facing the piezoelectric sheet 3*c*. As in the fifth embodiment (FIG. 6), the block 4 is a cylindrical block. However, unlike the fifth embodiment (FIG. 6), in the block 4, an area 42 having a prescribed size projects in the axial direction in the vicinity of the center of the second bottom surface, and this projecting area 42 is adhered to the second bottom surface of the housing 1. A hole for passing the projecting area 42 of the second bottom surface of the block 4 therethrough is opened in the second bottom surface portion 3D2 of the piezoelectric sheet 3*c*. The area other than the projecting area 42 of the second bottom surface of the block 4 opposes the second bottom surface portion 3D2 of the piezoelectric sheet 3*c* across a space 63. The block 4 can be adhered to either the first bottom surface or the second bottom surface of the housing 1.

The through-hole 5, which guides the air inside a space formed by the spaces 61 and 63 facing the piezoelectric sheet 3*c* to the sound emission hole 12 provided in the housing 1, is formed on the block 4. The configurations of the through-hole 5 and the opening 50 are the same as those in the fifth embodiment. In the shown example, the opening 50 of the through-hole 5 is located at a position on the side surface of the cylindrical block 4 that faces the center of the space formed by the spaces 61 and 63.

The same effects as those in the fifth embodiment can be obtained in the present embodiment. In addition, according to the present embodiment, the area of the piezoelectric sheet 3*c* facing the acoustic space inside the housing 1 can be made larger than that of the piezoelectric sheet 3*a* of the fifth embodiment. Accordingly, it is possible to make the sound pressure obtained in the earphone 106 higher than in the fifth embodiment.

In the same manner as in the fifth embodiment described above, in order to reduce the influence of an undesirable standing wave, the location of the opening 50 of the through-hole 5 can be matched to the positions at which the nodes of the standing wave occur in the space formed by the spaces 61 and 63 in the present embodiment as well.

Seventh Embodiment

Figure 8:
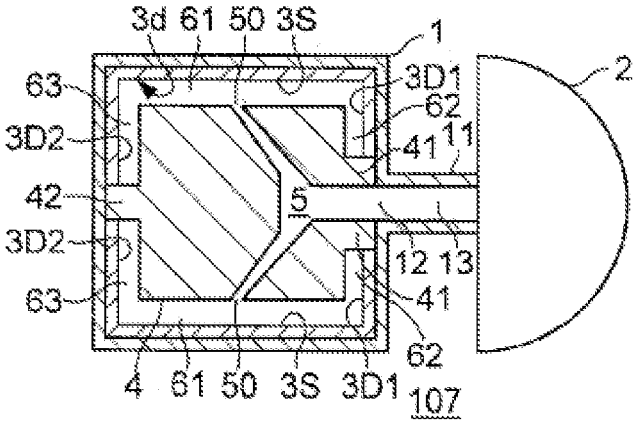
FIG. 8 is a view illustrating a configuration of an earphone, which is a seventh embodiment of the transducer according to the present disclosure.

FIG. 8 is a view illustrating a configuration of an earphone 107, which is the seventh embodiment of the transducer according to the present disclosure. In FIG. 8, parts corresponding to the respective parts shown in FIG. 7 have been assigned the same reference numerals, and the descriptions thereof have been omitted.

The earphone 107 according to the present embodiment is provided with a piezoelectric sheet 3*d* composed of the side surface portion 3S that covers the inside surface of the inner wall of the cylindrical housing 1, the first bottom surface portion 3D1 that covers the first bottom surface (bottom surface portion on the right side in FIG. 8), and the second bottom surface portion 3D2 that covers the second bottom surface (bottom surface portion on the left side in FIG. 8). The piezoelectric sheet 3*d* is bonded to the inner wall of the housing 1.

The block 4 is disposed in the acoustic space inside the housing 1 facing the piezoelectric sheet 3*d*. In the same manner as the sixth embodiment (FIG. 7), in the block 4, the area 42 having a prescribed size projects in the axial direction in the vicinity of the center of the second bottom surface, and the projecting area 42 is adhered to the second bottom surface of the housing 1. However, in the present embodiment, in addition to the foregoing, an area 41 having a prescribed size projects in the axial direction in the vicinity of the center of the first bottom surface of the block 4, and the projecting area 41 is adhered to the first bottom surface of the housing 1. A hole for passing the projecting area 41 of the first bottom surface of the block 4 therethrough is formed in the first bottom surface portion 3D1 of the piezoelectric sheet 3*d*. The area other than the projecting area 41 of the first bottom surface of the block 4 opposes the first bottom surface portion 3D1 of the piezoelectric sheet 3*d* across the space 62. The block 4 can be adhered to either the first bottom surface or the second bottom surface of the housing 1.

The through-hole 5, which guides the air inside the space formed by the spaces 61, 62 and 63 facing the piezoelectric sheet 3*d* to the sound emission hole 12 provided in the housing 1, is formed in the block 4. The configurations of the through-hole 5 and the opening 50 are the same as those in the fifth embodiment. In the example shown, the opening 50 of the through-hole 5 is located at a position on the side surface of the cylindrical block 4 that faces the center of the space formed by the spaces 61, 62, and 63.

The same effects as those in the sixth embodiment can be obtained in the present embodiment. In addition, according to the present embodiment, the area of the piezoelectric sheet 3*d* facing the acoustic space inside the housing 1 can be made larger than that of the piezoelectric sheet 3*c* of the sixth embodiment. Accordingly, it is possible to make the sound pressure obtained in the earphone 107 greater than in the sixth embodiment.

In the same manner as in the fifth and sixth embodiments described above, in order to reduce the influence of an undesirable standing wave, the location of the opening 50 of the through-hole 5 can be matched to the positions at which the nodes of the standing wave occur in the space formed by the spaces 61, 62, and 63 in the present embodiment as well.

Eighth Embodiment

Figure 9:
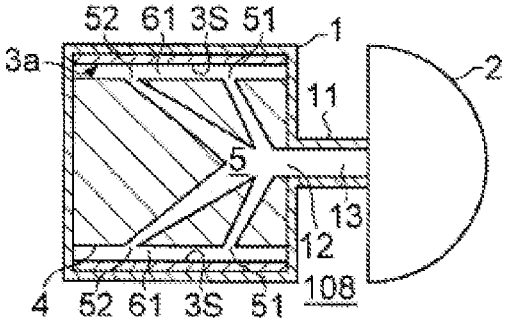
FIG. 9 is a view illustrating a configuration of an earphone, which is an eighth embodiment of the transducer according to the present disclosure.

FIG. 9 is a view illustrating a configuration of an earphone 108, which is the eighth embodiment of the transducer according to the present disclosure. In FIG. 9, those parts corresponding to the respective parts shown in FIG. 6 have been assigned the same reference numerals, and the descriptions thereof have been omitted.

In the earphone 108 according to the present embodiment, the configuration of the through-hole 5 provided in the block 4 is changed from that of the fifth embodiment. In the example shown in FIG. 9, the through-hole 5 is composed of a cylindrical first hollow area having essentially the same diameter as the sound path 13, a second hollow area that branches from the first hollow area and that extends radially toward the side surface of the cylindrical block 4, and a third hollow area that similarly branches from the first hollow area and that extends further toward the second bottom surface of the housing 1 (bottom surface on the left side in FIG. 9) than the second hollow area. Then, an opening 51 of the second hollow area and an opening 52 of the third hollow area of the through-hole 5 are provided on the side surface of the block 4. The openings 51 and 52 are circular openings that run once around the side surface of the cylindrical block 4. In the shown example, the openings 51 and 52 are located at positions that divide the side surface of the cylindrical block 4 into three equal parts. The block 4 can be adhered to either the first bottom surface or the second bottom surface of the housing 1.

The same effects as those in the fifth embodiment can be obtained in the present embodiment. In the same manner as in the fifth to the seventh embodiments described above, in order to reduce the influence of an undesirable standing wave, the locations of the openings 51, 52 of the through-hole 5 can be matched to the positions at which nodes of the standing wave occur in the space 61, in the present embodiment as well.

Confirming the Effects of the Embodiments

Figure 10A:
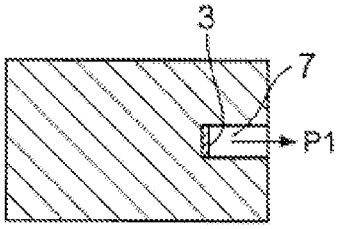
FIGS. 10A-10D are views explaining effects of the embodiments of the present disclosure.
Figure 10B:
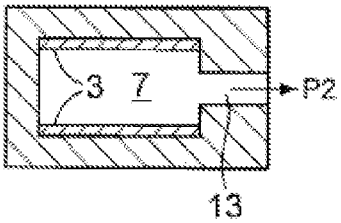
Figure 10C:
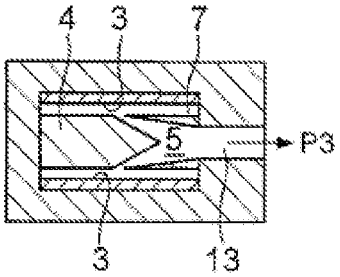

In order to confirm the effects of each of the embodiments described above, the present inventors carried out simulations of the acoustic characteristics of earphones using models of the earphones shown in FIGS. 10A to 10C.

The model shown in FIG. 10A is a model of an earphone with an ordinary straight-tube structure. In this model, a piezoelectric sheet 3 provided in a region corresponding to the bottom surface of a cylindrical acoustic space 7 emits sound into the acoustic space 7. The sound emitted into the acoustic space 7 is supplied to the user's ear canal unmodified.

The model shown in FIG. 10B is a model in which the cylindrical piezoelectric sheet 3 is disposed covering the side peripheral surface of the cylindrical acoustic space 7. In this model, the sound emitted into the acoustic space 7 is supplied to the user's ear canal via the sound path 13. This model corresponds to the first embodiment (FIG. 1) and the second embodiment (FIG. 3) described above.

The model shown in FIG. 10C is a model in which the cylindrical piezoelectric sheet 3 is disposed covering the side peripheral surface of the cylindrical acoustic space 7, and the block 4 having the through-hole 5 is disposed inside this piezoelectric sheet 3. In this model, the sound emitted into the acoustic space 7 is supplied to the user's ear canal via the through-hole 5 and the sound path 13. This model corresponds to the fifth to the eighth embodiments.

Figure 10D:
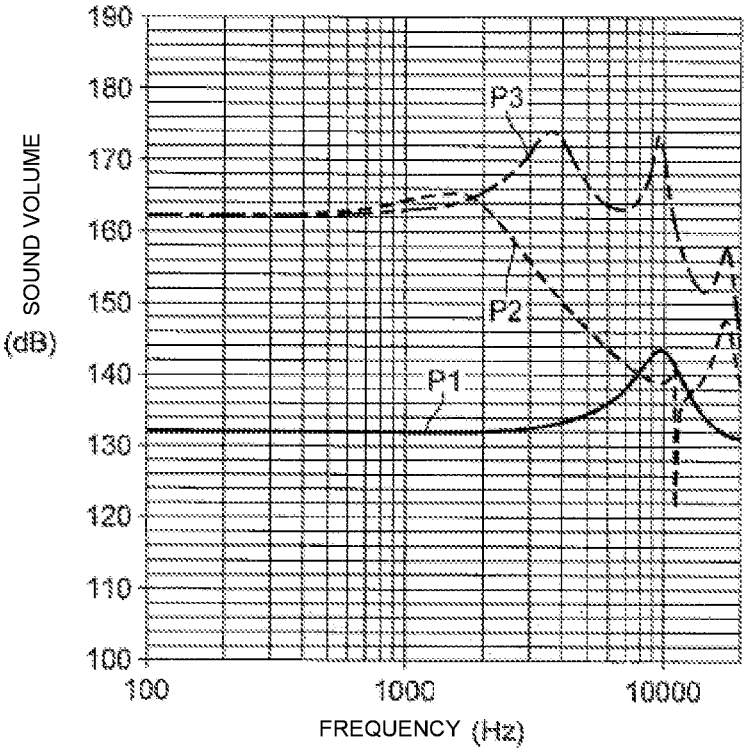

FIG. 10D shows simulation results in which the frequency characteristics of sound volume P1 obtained from the model shown in FIG. 10A, sound volume P2 obtained from the model shown in FIG. 10B, and sound volume P3 obtained from the model shown in FIG. 10C are shown. In this diagram, the horizontal axis represents frequency and the vertical axis, sound volume.

The following can be understood from FIG. 10D. Because there is little reflection, the model of the straight-tube structure shown in FIG. 10A exhibits a mostly flat frequency characteristic from the low-frequency range to the high-frequency range. However, it is thought that this model has drawbacks, such as the sound volume P1 being low throughout the entire range from the low-frequency range to the high-frequency range, but particularly the low-frequency range, and distortion tend to occur at high inputs, since the area of the piezoelectric sheet 3 is small.

On the other hand, in the model shown in FIG. 10B (that is, the first and second embodiments), since the area of the piezoelectric sheet 3 is increased, it is possible to confirm an increase in the sound volume P2. As a result, the low-frequency range characteristics can be improved in the actual product. This is because the output level of the low-frequency range increases with the area of the piezoelectric sheet 3. However, in this model, the characteristics of the high-frequency range deteriorate due to the influence of the standing wave that is generated inside the acoustic space 7 and the influence of the reflection that occurs in the discontinuous surface at the interface between the acoustic space 7 and the sound path 13.

In the model shown in FIG. 10C (that is, the fifth to the eighth embodiments), it is possible to reduce the influence of standing waves by adjusting the shape of the through-hole 5, and to suppress abrupt changes in the cross-sectional area at the boundary between the acoustic space 7, the through-hole 5, and the sound path 13. As a result, it is possible to improve the high-frequency range characteristics of the sound volume P3 obtained from the model.

OTHER EMBODIMENTS

Embodiments of the present disclosure are described above, but other embodiments of the present disclosure are conceivable. The following are some examples.

(1) In the above-described embodiments, the present disclosure is applied to an earphone that converts an audio signal into sound, but the application range of the present disclosure is not limited thereto. This disclosure can also be applied to a transducer that transduces sound into an electronic signal, such as a microphone.

(2) In the above-described embodiments, the housing 1 has a cylindrical shape, but the housing 1 can have another shape besides cylindrical, such as spherical or that of a rectangular parallelepiped.

(3) In the fifth to the eight embodiments, if the frequency of the standing wave that is generated in the space inside the housing 1 facing the piezoelectric sheet is outside the frequency range used by the earphone, it is not necessary to match the location of the opening of the through-hole 5 of the block 4 to the positions at which the nodes of the standing wave occur.

(4) In the fifth to the eight embodiments, the frequency of the standing wave that is generated in the space inside the housing 1 facing the piezoelectric sheet can be shifted outside of the frequency range that is used by the earphone. Specifically, for example, at the branches of the through-hole 5 in the block 4 shown in FIG. 9, the frequency at which the length of the path that extends from the opening 51 on the piezoelectric sheet 3*a* side and around the distal end of the sound emission hole 12 side, passes through the opening 52 adjacent to the opening 51, and reaches the opening 51, becomes the wavelength, and is set to be lower than the lower limit frequency of the frequency range that is used. Alternatively, the frequency is set to be above the upper limit of the frequency range used. In this way, it is possible to shift the frequency of the standing wave that is generated in the acoustic space between the piezoelectric sheet 3*a* and the block 4 outside of the frequency range that is used and to negate the adverse influence of the standing wave on the acoustic characteristics.

What is claimed is:

1. A transducer comprising:

a hollow housing has a cylindrical shape, the hollow housing including at least one sound emission hole and an inner wall, the inner wall including a tubular inner surface;

a connection tube which has a first end that is connected to the sound emission hole and a second end that is opposite to the first end and is connected to an earpiece;

a piezoelectric sheet disposed on a first portion of the inner wall in the tubular inner surface; and a block disposed on a second portion of the inner wall that is different than the tubular inner surface.

2. The transducer according to claim 1, wherein the inner wall further includes a first surface and a second surface that faces the first surface, the block is disposed on the second portion that is a portion of the second surface, and the first surface has the sound emission hole configured to emit a sound from an internal space of the hollow housing to an external space of the hollow housing.

3. The transducer according to claim 2, wherein the block is separate from the first surface.

4. The transducer according to claim 1, wherein the block has a through-hole configured to guide air that faces the piezoelectric sheet to the sound emission hole.

5. The transducer according to claim 4, wherein the through-hole has a cross-sectional area that increases as the through-hole approaches the sound emission hole.

6. The transducer according to claim 4, wherein the block has a side surface that is separate from the piezoelectric sheet disposed on at least the first portion of the inner wall, and the side surface of the block has an opening of the through-hole.

7. The transducer according to claim 4, wherein the inner wall further has a first surface and a second surface that faces the first surface, the block is disposed on the second portion that is a portion of the second surface, and the first surface has the sound emission hole configured to emit a sound from an internal space of the hollow housing to an external space of the hollow housing.

8. The transducer according to claim 4, wherein the inner wall further has a first surface and a second surface that faces the first surface, and the block is disposed on the second portion that is a portion of the second surface.

9. The transducer according to claim 8, wherein the block is further disposed on a portion of the first surface.

* * * * *